US009630439B2

(12) United States Patent
Ohnishi

(10) Patent No.: US 9,630,439 B2
(45) Date of Patent: Apr. 25, 2017

(54) PRINTING METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/077,893

(22) Filed: Mar. 22, 2016

(65) Prior Publication Data

US 2016/0279973 A1 Sep. 29, 2016

(30) Foreign Application Priority Data

Mar. 24, 2015 (JP) ..... 2015-060614

(51) Int. Cl.

| | |
|---|---|
| ***B41M 7/00*** | (2006.01) |
| ***B41J 2/005*** | (2006.01) |
| ***B41M 3/12*** | (2006.01) |
| ***B41M 5/00*** | (2006.01) |
| ***B42D 25/387*** | (2014.01) |
| *B41J 2/01* | (2006.01) |

(52) U.S. Cl.

CPC ..... *B41M 7/0081* (2013.01); *B41J 2/0057* (2013.01); *B41M 3/12* (2013.01); *B41M 5/0047* (2013.01); *B41M 5/0064* (2013.01); *B42D 25/387* (2014.10); *B41J 2002/012* (2013.01); *B41M 2205/10* (2013.01)

(58) Field of Classification Search

CPC B41M 7/0081; B41M 5/0047; B41M 5/0064; B41M 3/12; B41M 2205/10; B41J 2/0057; B41J 2002/012; B42D 25/387

See application file for complete search history.

(56) References Cited

U.S. PATENT DOCUMENTS 5,267,755 A * 12/1993 Yamauchi ..... B32B 38/14 283/109
2002/0158947 A1* 10/2002 Kanno ..... B41J 2/161 347/70
2003/0007058 A1* 1/2003 Odamura ..... B41M 3/12 347/187
2009/0225143 A1* 9/2009 Fukui ..... B41J 2/14233 347/102

(Continued)

FOREIGN PATENT DOCUMENTS

WO 2010073305 7/2010

*Primary Examiner* — Justin Seo
(74) *Attorney, Agent, or Firm* — Jianq Chyun IP Office

(57) ABSTRACT

A printing method is provided. In this printing method, a printing ink composed of pigment-based solvent UV ink or UV ink is applied onto a transfer sheet capable of transmitting an ultraviolet light, and then the printing ink is cured to form a printing ink layer. Thereafter, a bonding ink composed of solvent UV ink or UV ink for bonding the printing ink layer to a medium is applied onto the printing ink layer. Subsequently, the bonding ink is pressed against the medium. In this state, irradiation with the ultraviolet light from an opposite surface of the transfer sheet to a surface having the printing ink layer formed thereon is performed, such that the bonding ink is completely cured to form a bonding ink layer. Thereafter, the transfer sheet is peeled off from the printing ink layer, whereby the printing ink layer is transferred onto the medium.

12 Claims, 3 Drawing Sheets

(56) References Cited

U.S. PATENT DOCUMENTS

| | | | | |
|---|---|---|---|---|
| 2010/0159218 | A1* | 6/2010 | Yum | B41M 5/52 428/201 |
| 2011/0104460 | A1* | 5/2011 | Souma | D06P 1/5285 428/201 |
| 2012/0154497 | A1* | 6/2012 | Nakao | B41J 2/0057 347/102 |
| 2014/0234587 | A1* | 8/2014 | Maneira | B41C 1/00 428/195.1 |

* cited by examiner

PRINTING METHOD

CROSS REFERENCE TO RELATED APPLICATIONS

This application claims the priority benefit of Japanese Patent Application No. 2015-060614, filed on Mar. 24, 2015. The entirety of the above-mentioned patent application is hereby incorporated by reference herein and made a part of this specification.

TECHNICAL FIELD

The disclosure relates to a printing method of performing printing on a print medium with pigment-based ink.

DESCRIPTION OF THE BACKGROUND ART

In the related art, there is known a printing method of performing printing on fabric (textile) with pigment-based ink (see Patent Document 1 for instance). In the printing method disclosed in Patent Document 1, water-based pigment ink is applied to a surface of fabric in an inkjet scheme.

[Patent Document 1] WO 2010/73305

In a case of performing printing on a print medium having nap on a surface thereof, such as fabric, with pigment-based ink, it is difficult to sufficiently infiltrate pigment-based ink into the tip portion of the nap. For this reason, in a case of performing printing on fabric with pigment-based ink by the printing method disclosed in Patent Document 1, it is concerned that some parts of the tip portion of the nap on the surface of the fabric will not be infiltrated with ink. Also, if some parts of the tip portion of the nap are not infiltrated with ink, it is concerned that those parts having not been infiltrated with ink may cause an image to be blurredly formed on the surface of the fabric.

SUMMARY

Thus, the disclosure provides a printing method capable of forming a clear image on the surface of a print medium having nap on a surface thereof, such as fabric, even in a case of performing printing on the medium with pigment-based ink.

Therefore, a printing method of the disclosure includes: a printing-ink applying process of applying a printing ink onto a transfer sheet capable of transmitting an ultraviolet light, and the printing ink is pigment-based and composed of a solvent UV ink or an UV ink; a printing-ink layer forming process of irradiating the printing ink being applied with the ultraviolet light while heating the printing ink, in a state where the printing ink is the solvent UV ink, but irradiating the printing ink being applied with the ultraviolet light in a state where the printing ink is the UV ink, such that the printing ink is cured to form a printing ink layer; a bonding-ink applying process of applying a bonding ink onto the printing ink layer, and the bonding ink is composed of the solvent UV ink or the UV ink for bonding the printing ink layer to a medium; a bonding-ink layer forming process of performing irradiation with the ultraviolet light from an opposite surface of the transfer sheet to a surface having the printing ink layer formed thereon, in a state where the bonding ink has been pressed against the medium, such that the bonding ink is completely cured to foam a bonding ink layer; and an ink-layer transferring process of peeling off the transfer sheet from the printing ink layer, thereby transferring the printing ink layer onto the medium, and the ink-layer transferring process is performed after the bonding-ink layer forming process.

Also, another printing method of the disclosure includes: a printing-ink applying process of applying a printing ink onto a transfer sheet capable of transmitting an ultraviolet light, and the printing ink is pigment-based and composed of a solvent UV ink or an UV ink; a printing-ink layer forming process of irradiating the printing ink being applied with the ultraviolet light while heating the printing ink, in a state where the printing ink is the solvent UV ink, but irradiating the printing ink being applied with the ultraviolet light in a state where the printing ink is the UV ink, such that the printing ink is cured to form a printing ink layer; a bonding-ink applying process of applying a bonding ink to a medium, and the bonding ink is composed of the solvent UV ink or the UV ink for bonding the printing ink layer to the medium; a bonding-ink layer forming process of performing irradiation with the ultraviolet light from the opposite surface of the transfer sheet to a surface having the printing ink layer formed thereon, in a state where the printing ink layer has been pressed against the bonding ink, such that the bonding ink is completely cured to form a bonding ink layer; and an ink-layer transferring process of peeling off the transfer sheet from the printing ink layer, thereby transferring the printing ink layer onto the medium, and the ink-layer transferring process is performed after the bonding-ink layer forming process.

In each printing method of the disclosure, in the printing-ink layer forming process, the printing ink is cured on the transfer sheet, thereby forming the printing ink layer, and the printing ink layer is bonded to the medium in the bonding-ink layer forming process. Thereafter, in the ink-layer transferring process, the transfer sheet is peeled off from the printing ink layer, whereby the printing ink layer is transferred onto the medium. Therefore, in the disclosure, even in a case of performing printing on a print medium having nap on a surface thereof, such as fabric, with pigment-based printing ink, on the surface of the medium, the whole of the printing ink layer does not infiltrate into the nap, and the printing ink layer is formed on the surface side of the medium relative to the tip of the nap. Therefore, if printing is performed by any one printing method of the disclosure, even in a case of performing printing on a print medium having nap on a surface thereof with pigment-based printing ink, it is possible to form a clear image on the surface of the medium.

Also, in each printing method of the disclosure, in a case of applying the bonding ink onto the printing ink layer in the bonding-ink applying process, for example, if application of the printing ink and application of the bonding ink are performed by an inkjet printer, it is possible to easily perform aligning of the printing ink layer and the bonding ink layer. Also, solvent UV ink means ink obtained by diluting a monomer, an oligomer, or the like which can be cured by ultraviolet light, with a solvent.

Each printing method of the disclosure may further include: a bonding-ink semi-curing process which is performed between the bonding-ink applying process and the bonding-ink layer forming process, wherein the bonding-ink semi-curing process irradiates the bonding ink being applied with the ultraviolet light while heating the bonding ink, in a state where the bonding ink is the solvent UV ink, but irradiates the bonding ink being applied with the ultraviolet light in a state where the bonding ink is the UV ink, such that the bonding ink is semi-cured. According to this configuration, it becomes possible to suppress running of the bonding ink in the bonding-ink layer forming process, even in a state where the bonding ink which is applied in the bonding-ink applying process has low viscosity. Therefore, it becomes possible to form the bonding ink layer at an appropriate position in the bonding-ink layer forming process, whereby it becomes possible to surely bond the printing ink layer to the medium by the bonding ink layer.

In the disclosure, in the bonding-ink layer forming process, in a state where the transfer sheet and the medium have been disposed in a case having an exhaust hole formed therein, or in a state where the medium has been disposed in the case having an opening and the exhaust hole and the opening has been covered with the transfer sheet such that the printing ink layer has been disposed in the case, while air in the case is sucked from the exhaust hole such that a pressure of an inside of the case decreases, irradiation with the ultraviolet light may be performed. According to this configuration, in the bonding-ink layer forming process, it is possible to perform irradiation with ultraviolet light in a state where the medium and the bonding ink are in close contact with each other, or in a state where the printing ink layer and the bonding ink are in close contact with each other, such that the bonding ink is completely cured. Therefore, in the bonding-ink layer forming process, it is possible to surely bond the printing ink layer to the medium by the bonding ink layer.

Also, in the disclosure, in the bonding-ink layer forming process, while the transfer sheet is pressed from the opposite surface of the transfer sheet to a surface having the printing ink layer formed thereon, by a pressing member made of a rubber material capable of transmitting the ultraviolet light, irradiation with the ultraviolet light through the pressing member may be performed. Even in this case, in the bonding-ink layer forming process, it is possible to perform irradiation with ultraviolet light in a state where the medium and the bonding ink are in close contact with each other, or in a state where the printing ink layer and the bonding ink are in close contact with each other, such that the bonding ink is completely cured. Therefore, it is possible to surely bond the printing ink layer to the medium by the bonding ink layer.

As described above, if printing is performed by any one printing method of the disclosure, even in a case of performing printing on a print medium having nap on a surface thereof, such as fabric, with pigment-based ink, it becomes possible to form a clear image on the surface of the medium.

DETAILED DESCRIPTION OF EMBODIMENTS

Hereinafter, embodiments of the disclosure will be described with reference to the drawings.

(Printing Method of Printed Matter)

Figure 1:
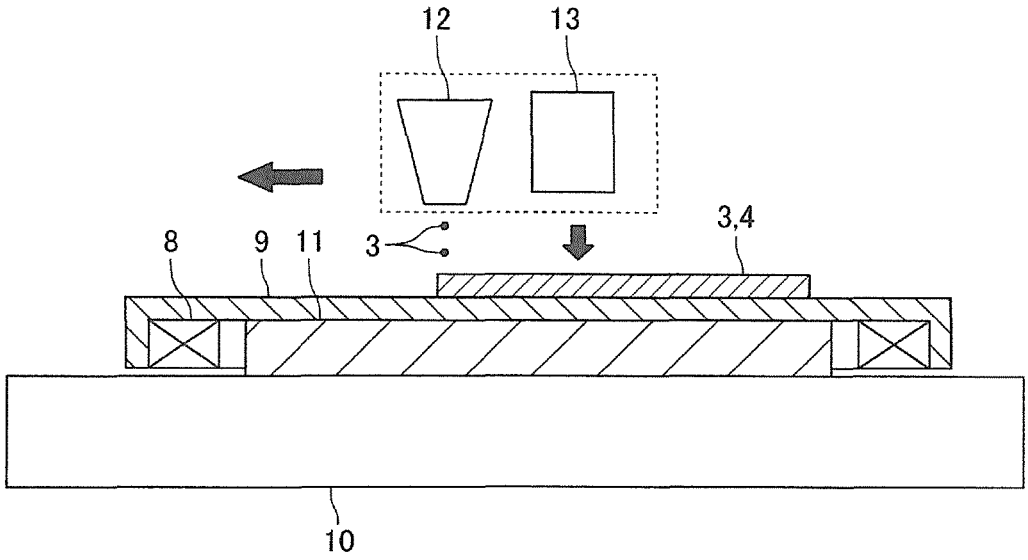
FIG. 1 is a schematic view for explaining a printing-ink applying process and a printing-ink layer forming process according to an embodiment of the disclosure.
Figure 2:
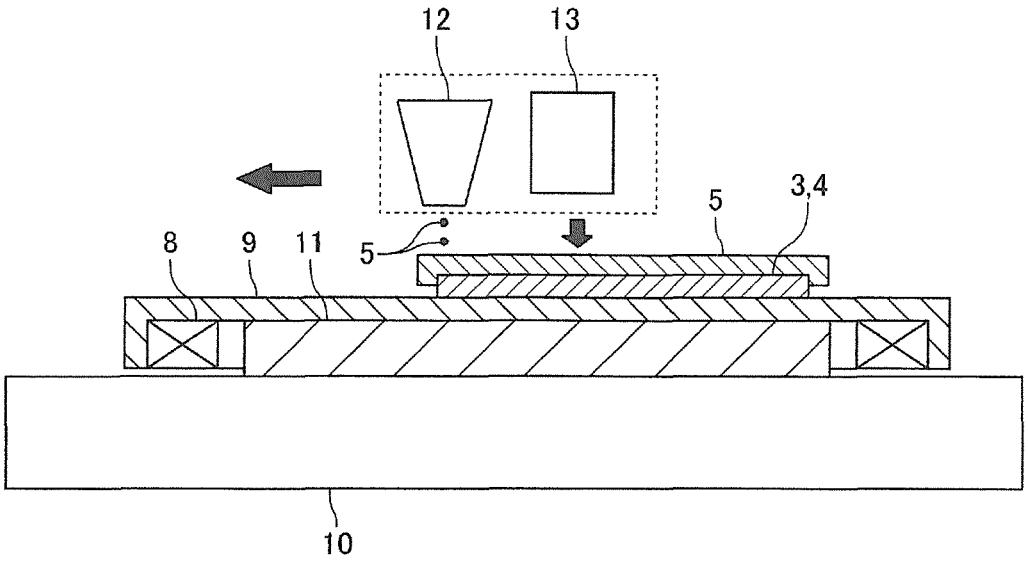
FIG. 2 is a schematic view for explaining a bonding-ink applying process according to the embodiment of the disclosure.
Figure 3:
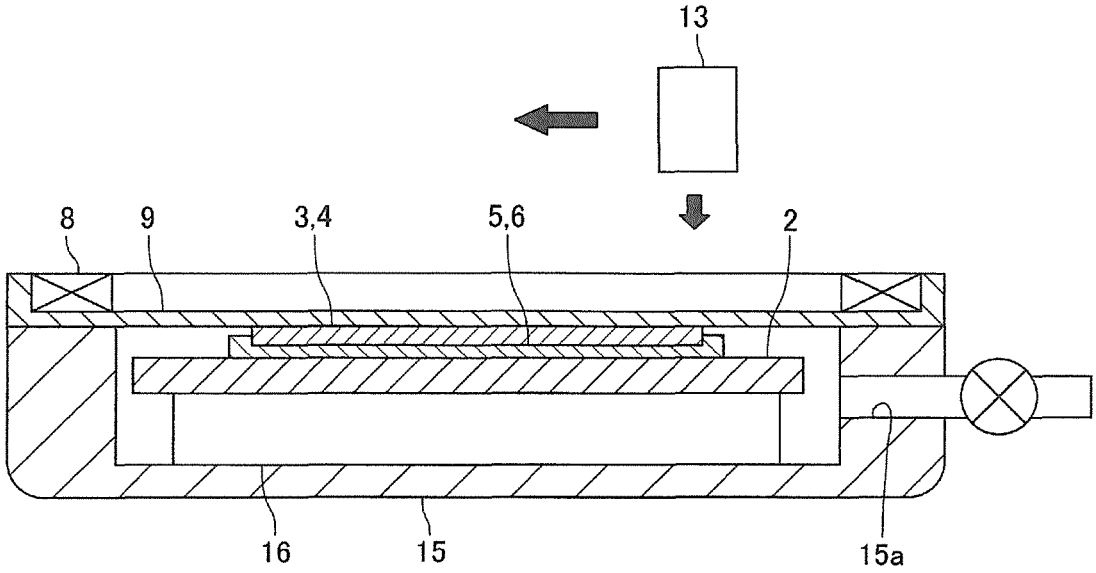
FIG. 3 is a schematic view for explaining a bonding-ink layer forming process according to the embodiment of the disclosure.
Figure 4:
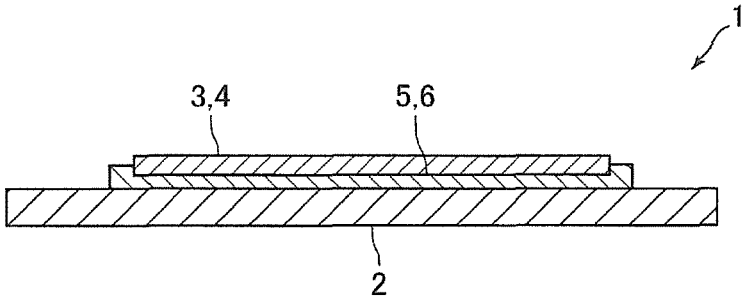
FIG. 4 is a cross-sectional view of a printed matter obtained by performing printing by a printing method according to the embodiment of the disclosure.

FIG. 1 is a schematic view for explaining a printing-ink applying process and a printing-ink layer following process according to an embodiment of the disclosure. FIG. 2 is a schematic view for explaining a bonding-ink applying process according to the embodiment of the disclosure. FIG. 3 is a schematic view for explaining a bonding-ink layer forming process according to the embodiment of the disclosure. FIG. 4 is a cross-sectional view of a printed matter 1 obtained by performing printing by a printing method according to the embodiment of the disclosure.

The printed matter 1 (see FIG. 4) obtained by performing printing by the printing method of the present embodiment is a printed matter obtained by drawing various images such as letters, pictures (figures), and designs on the surface of a medium 2 for being used in printing. The medium 2 is a medium for being used in printing which has nap on a surface thereof. In the present embodiment, the medium 2 is fabric (textile). As shown in FIG. 4, on the surface of the medium 2, a printing ink layer 4 which is a layer of ink 3 for printing (printing ink 3) for drawing images such as letters and pictures on the surface of the medium 2 is bonded by a bonding ink layer 6 which is a layer of ink 5 for bonding (bonding ink 5). Alternatively, the medium 2 may be paper having nap on a surface thereof, such as Japanese paper, or mat-shaped or grained plastic, metal, or glass having uneven surfaces.

The printing ink 3 is pigment-based ink. Also, the printing ink 3 is solvent UV ink. In other words, the printing ink 3 is ink obtained by diluting an UV-curable resin (an ultraviolet curable resin), which cures if it is irradiated with ultraviolet light, with an organic solvent. The printing ink 3 is soft ink which forms the printing ink layer 4 such that, even if the printing ink layer 4 extends by 140%, the printing ink layer does not crack or break, for example, ink obtained by diluting UV ink, made by MIMAKI ENGINEERING CO., LTD. and specified by the model No. "LF-140", with an organic solvent. The printing ink 3 is colored in a color different from the color of the surface of the medium 2. Also, the printing ink 3 includes ink of a plurality of colors for drawing images such as letters and pictures on the surface of the medium 2. Also, the UV-curable resin which is contained in the printing ink 3 is, for example, any one of types which are cured by radical polymerization or cationic polymerization, or a mixture thereof.

The bonding ink 5 is solvent UV ink for bonding the printing ink layer 4 to the medium 2. The bonding ink 5 is soft ink which forms the bonding ink layer 6 such that, even if the bonding ink layer 6 extends by 140%, the bonding ink layer does not crack or break. Further, the bonding ink 5 is transparent clear ink. Also, the bonding ink 5 may be colored in the same color as the color of the surface of the medium 2. Also, the UV-curable resin which is contained in the bonding ink 5 is, for example, any one of types which are cured by radical polymerization or cationic polymerization, or a mixture thereof.

Printing on the medium 2 is performed as follows. First, as shown in FIG. 1, a transfer sheet 9 attached to a frame-shaped sheet holder 8 is set on a table 10. On the table 10, a heater 11 for curing the printing ink 3 and the bonding ink 5 is installed in advance, and the transfer sheet 9 is set on the table 10, for example, such that the heater 11 comes into contact with the transfer sheet 9. Also, the transfer sheet 9 is made of a material capable of transmitting ultraviolet light. Also, the transfer sheet 9 is made of, for example, polypropylene or silicone rubber. Alternatively, the transfer sheet 9 is configured by a film-like member coated with a silicon resin or a fluorine resin.

Thereafter, as shown in FIG. 1, the printing ink 3 is ejected from an inkjet head 12 of an inkjet printer disposed above the transfer sheet 9, whereby the printing ink 3 is applied onto the transfer sheet 9 (a printing-ink applying process). Also, while the printing ink 3 applied in the printing-ink applying process is heated by the heater 11, the printing ink 3 is irradiated with ultraviolet light by an ultraviolet lamp 13, whereby the printing ink 3 is cured to form the printing ink layer 4 (a printing-ink layer following process). In other words, while the organic solvent is vaporized by the heater 11, the UV-curable resin is cured by the ultraviolet lamp 13, whereby the printing ink 3 is cured to form the printing ink layer 4. In the present embodiment, in the printing-ink layer forming process, the printing ink 3 is completely cured.

Thereafter, as shown in FIG. 2, the bonding ink 5 is ejected from the inkjet head 12, whereby the bonding ink 5 is applied onto the printing ink layer 4 (a bonding-ink applying process). In the bonding-ink applying process, the bonding ink 5 is applied so as to cover the whole of the printing ink layer 4. Thereafter, while the applied bonding ink 5 is heated by the heater 11, the bonding ink 5 is irradiated with ultraviolet light in low illuminance by the ultraviolet lamp 13, whereby the bonding ink 5 is semi-cured (a bonding-ink semi-curing process). In other words, while the organic solvent is vaporized by the heater 11, the UV-curable resin is semi-cured by the ultraviolet lamp 13, whereby the bonding ink 5 is semi-cured. In the bonding-ink semi-curing process, the bonding ink 5 is semi-cured, for example, such that the viscosity of the bonding ink 5 becomes 100,000 mPa·sec or less.

Thereafter, the transfer sheet 9 attached to the sheet holder 8 is unloaded from the table 10, and in a state where the bonding ink 5 has been pressed against the medium 2 as shown in FIG. 3, irradiation with ultraviolet light from the opposite surface of the transfer sheet 9 to the surface having the printing ink layer 4 formed thereon is performed, whereby the bonding ink 5 is completely cured to form the bonding ink layer 6 (a bonding-ink layer forming process). In the bonding-ink layer forming process, the medium 2 is disposed in a case 15 having an opening at a top thereof and having an exhaust hole 15*a* formed therein, and the opening of the case 15 is covered with the transfer sheet 9 such that the printing ink layer 4 is disposed inside the case 15. In this state, while air in the case 15 is sucked from the exhaust hole 15*a* such that the pressure of the inside of the case 15 decreases, irradiation with ultraviolet light is performed by the ultraviolet lamp 13. Also, in the case 15, the medium 2 is attached to a table 16 having a planar or curved top surface.

Thereafter, the transfer sheet 9 is peeled off from the printing ink layer 4, whereby the printing ink layer 4 is transferred onto the medium 2 (an ink-layer transferring process). If the ink-layer transferring process finishes, as shown in FIG. 4, the printing ink layer 4 is bonded to the surface of the medium 2 by the bonding ink layer 6, whereby printing on the medium 2 is completed.

Main Effects of Present Embodiment

As described above, in the present embodiment, in the printing-ink layer forming process, the printing ink 3 is cured on the transfer sheet 9, thereby forming the printing ink layer 4, and the printing ink layer is bonded to the medium 2 in the bonding-ink layer forming process. Thereafter, in the ink-layer transferring process, the transfer sheet 9 is peeled off from the printing ink layer 4, whereby the printing ink layer 4 is transferred onto the medium 2. Therefore, in the present embodiment, even in a case of performing printing on the print medium 2 having the nap on a surface thereof with the pigment-based printing ink 3, on the surface of the medium 2, the whole of the printing ink layer 4 does not infiltrate into the nap, and the printing ink layer 4 is formed on the surface side of the printed matter 1 relative to the tip of the nap. Therefore, if printing is performed by the printing method of the present embodiment, even in the case of performing printing on the print medium 2 having the nap on a surface thereof with the pigment-based printing ink 3, it is possible to form a clear image on the surface of the medium 2.

Also, in the present embodiment, in the bonding-ink applying process, the bonding ink 5 is applied onto the printing ink layer 4 by the inkjet head 12 of the inkjet printer. Therefore, it is possible to easily performing aligning of the printing ink layer 4 and the bonding ink 5.

In the present embodiment, in the bonding-ink semi-curing process, while the bonding ink 5 is heated, the bonding ink 5 is irradiated with ultraviolet light, whereby the bonding ink 5 is semi-cured. Therefore, in the present embodiment, even in a case where the bonding ink 5 which is applied in the bonding-ink applying process has low viscosity, it is possible to suppress running of the bonding ink 5 in the bonding-ink layer forming process. Therefore, in the present embodiment, it becomes possible to form the bonding ink layer 6 at an appropriate position in the bonding-ink layer forming process, whereby it becomes possible to surely bond the printing ink layer 4 to the medium 2 by the bonding ink layer 6.

In the present embodiment, in the bonding-ink layer forming process, the medium 2 is disposed in the case 15, and the opening of the case 15 is covered with the transfer sheet 9 such that the printing ink layer 4 is disposed inside the case 15. In this state, air in the case 15 is sucked from the exhaust hole 15*a* such that the pressure of the inside of the case 15 decreases. Therefore, in the present embodiment, in the bonding-ink layer forming process, irradiation with ultraviolet light can be performed in a state where the medium 2 and the bonding ink 5 are in close contact with each other, whereby it is possible to completely cure the bonding ink 5. Therefore, in the present embodiment, in the bonding-ink layer forming process, it is possible to surely bond the printing ink layer 4 to the medium 2 by the bonding ink layer 6.

Other Embodiments

In the above described embodiment, in the bonding-ink layer forming process, the medium 2 is disposed in the case 15 with the opening at the top thereof, and the opening of the case 15 is covered with the transfer sheet 9. In this state, air in the case 15 is sucked from the exhaust hole 15*a* such that the pressure of the inside of the case 15 decreases. Alternatively, for example, in the bonding-ink layer forming process, the medium 2 and the transfer sheet 9 may be disposed in a case having a lid with an exhaust hole formed therein. In this state, air in the case may be sucked from the exhaust hole such that the pressure of the inside of the case decreases. In this case, the lid of the case is made of a material capable of transmitting ultraviolet light.

Figure 5:
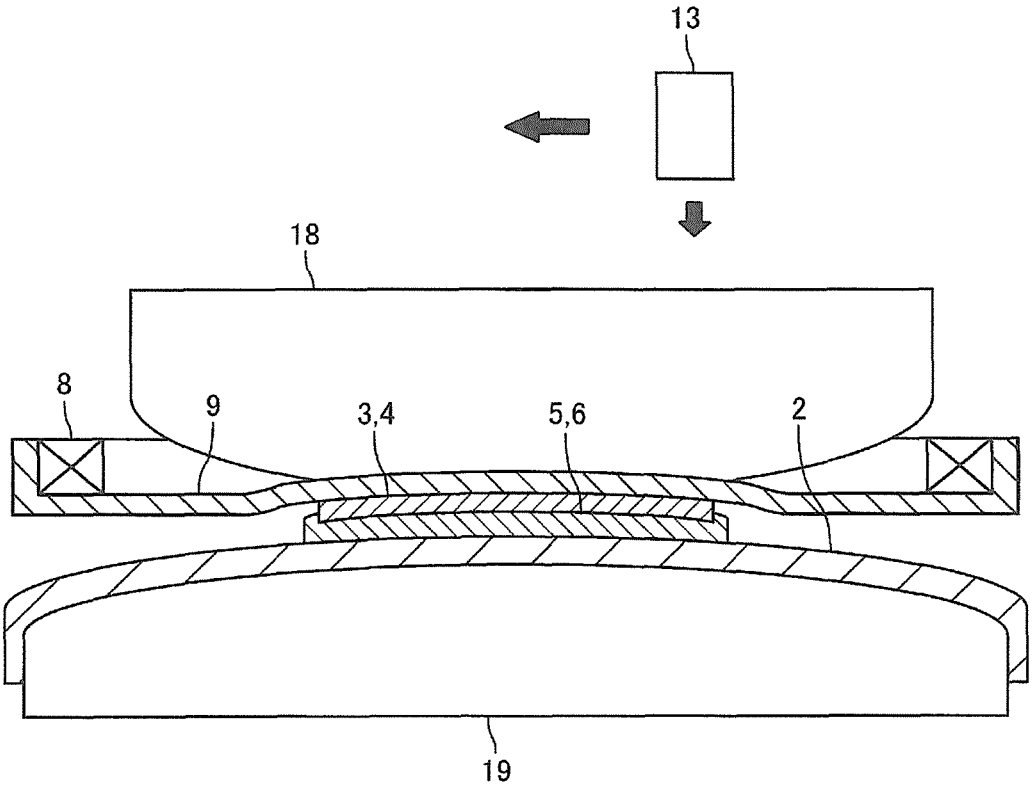
FIG. 5 is a schematic view for explaining a bonding-ink layer forming process according to another embodiment of the disclosure.

Also, in the bonding-ink layer forming process, as shown in FIG. 5, while the transfer sheet 9 is pressed from the opposite surface of the transfer sheet 9 to the surface having the printing ink layer 4 formed thereon, by a pressing member 18 made of a rubber material capable of transmitting ultraviolet light, irradiation with ultraviolet light through the pressing member 18 may be performed. Even in this case, in the bonding-ink layer forming process, irradiation with ultraviolet light can be performed in a state where the medium 2 and the bonding ink 5 are in close contact with each other, whereby it is possible to completely cure the bonding ink 5, and thus it is possible to surely bond the printing ink layer 4 to the medium 2 by the bonding ink layer 6. Also, the pressing member 18 is a rubber pad made entirely of a rubber material, or a pad made by enclosing liquid or gas in a bag made of a rubber material. Also, in the example shown in FIG. 5, for example, the medium 2 is attached to the curved top surface of a table 19, and the lower surface of the pressing member 18 pressing the transfer sheet 9 is deformed according to the shape of the top surface of the table 19.

In the above described embodiment, in the bonding-ink semi-curing process, while the bonding ink 5 is heated, the bonding ink 5 is irradiated with ultraviolet light, whereby the bonding ink 5 is semi-cured. However, for example, if the viscosity of the bonding ink 5 is relatively high, the bonding-ink semi-curing process may be omitted. Also, if the viscosity of the bonding ink 5 is relatively high, in the bonding-ink semi-curing process, only heating of the bonding ink 5 may be performed, without irradiating the bonding ink 5 with ultraviolet light.

In the above described embodiment, in the bonding-ink applying process, the bonding ink 5 is applied onto the printing ink layer 4. However, in the bonding-ink applying process, the bonding ink 5 may be applied to the surface of the medium 2. In this case, in the bonding-ink layer forming process, in a state where the printing ink layer 4 on the transfer sheet 9 has been pressed against the bonding ink 5 on the medium 2, irradiation with ultraviolet light from the opposite surface of the transfer sheet 9 to the surface having the printing ink layer 4 formed thereon may be performed, such that the bonding ink 5 is completely cured to form the bonding ink layer 6. Even in this case, on the surface of the medium 2, the whole of the printing ink layer 4 does not infiltrate into the nap, and the printing ink layer 4 is formed on the surface side of the printed matter 1 relative to the tip of the nap. Therefore, similarly in the above described embodiment, it is possible to form a clear image on the surface of the medium 2.

In the above described embodiment, the printing ink 3 is solvent UV ink. However, the printing ink 3 may be UV ink composed of a UV-curable resin. In this case, in the printing-ink layer foaming process, the printing ink 3 may be irradiated with ultraviolet light, such that the printing ink 3 is cured to form the printing ink layer 4. Also, in the above described embodiment, the bonding ink 5 is solvent UV ink. However, the bonding ink 5 may be UV ink. In this case, in the bonding-ink semi-curing process, the bonding ink 5 may be irradiated with ultraviolet light with low illuminance, such that the bonding ink 5 is semi-cured. Also, in a case where the printing ink 3 and the bonding ink 5 are UV ink, the heater 11 may not be installed on the table 10.

What is claimed is:

1. A printing method, comprising:

a printing-ink applying process of applying a printing ink onto a transfer sheet capable of transmitting an ultraviolet light, and the printing ink is pigment-based and composed of a solvent UV ink or an UV ink;

a printing-ink layer forming process of irradiating the printing ink being applied with the ultraviolet light while heating the printing ink, in a state where the printing ink is the solvent UV ink, but irradiating the printing ink being applied with the ultraviolet light in a state where the printing ink is the UV ink, such that the printing ink is cured to form a printing ink layer;

a bonding-ink applying process of applying a bonding ink onto the printing ink layer, and the bonding ink is composed of the solvent UV ink or the UV ink for bonding the printing ink layer to a medium;

a bonding-ink layer forming process of performing irradiation with the ultraviolet light from an opposite surface of the transfer sheet to a surface having the printing ink layer formed thereon, in a state where the bonding ink has been pressed against the medium, such that the bonding ink is completely cured to form a bonding ink layer; and an ink-layer transferring process of peeling off the transfer sheet from the printing ink layer to transfer the printing ink layer onto the medium, and the ink-layer transferring process is performed after the bonding-ink layer forming process.

2. The printing method according to claim 1, further comprising:

a bonding-ink semi-curing process which is performed between the bonding-ink applying process and the bonding-ink layer forming process, wherein the bonding-ink semi-curing process irradiates the bonding ink being applied with the ultraviolet light while heating the bonding ink, in a state where the bonding ink is the solvent UV ink, but irradiates the bonding ink being applied with the ultraviolet light in a state where the bonding ink is the UV ink, such that the bonding ink is semi-cured.

3. The printing method according to claim 1, wherein in the bonding-ink layer forming process, in a state where the transfer sheet and the medium have been disposed in a case having an exhaust hole formed therein, or in a state where the medium has been disposed in the case having an opening and the exhaust hole and the opening has been covered with the transfer sheet such that the printing ink layer has been disposed in the case, while air in the case is sucked from the exhaust hole such that a pressure of an inside of the case decreases, irradiation with the ultraviolet light is performed.

4. The printing method according to claim 2, wherein in the bonding-ink layer forming process, in a state where the transfer sheet and the medium have been disposed in a case having an exhaust hole formed therein, or in a state where the medium has been disposed in the case having an opening and the exhaust hole and the opening has been covered with the transfer sheet such that the printing ink layer has been disposed in the case, while air in the case is sucked from the exhaust hole such that a pressure of an inside of the case decreases, irradiation with the ultraviolet light is performed.

5. The printing method according to claim 1, wherein in the bonding-ink layer forming process, while the transfer sheet is pressed from an opposite surface of the transfer sheet to a surface having the printing ink layer formed thereon, by a pressing member made of a rubber material capable of transmitting the ultraviolet light, irradiation with the ultraviolet light through the pressing member is performed.

6. The printing method according to claim 2, wherein in the bonding-ink layer forming process, while the transfer sheet is pressed from an opposite surface of the transfer sheet to a surface having the printing ink layer formed thereon, by a pressing member made of a rubber material capable of transmitting the ultraviolet light, irradiation with the ultraviolet light through the pressing member is performed.

7. A printing method, comprising:

a printing-ink applying process of applying a printing ink onto a transfer sheet capable of transmitting an ultraviolet light, and the printing ink is pigment-based and composed of a solvent UV ink or an UV ink;

a printing-ink layer forming process of irradiating the printing ink being applied with the ultraviolet light while heating the printing ink, in a state where the printing ink is the solvent UV ink, but irradiating the printing ink being applied with the ultraviolet light in a state where the printing ink is the UV ink, such that the printing ink is cured to form a printing ink layer;

a bonding-ink applying process of applying a bonding ink to a medium, and the bonding ink is composed of the solvent UV ink or the UV ink for bonding the printing ink layer to the medium;

a bonding-ink layer forming process of performing irradiation with the ultraviolet light from an opposite surface of the transfer sheet to a surface having the printing ink layer formed thereon, in a state where the printing ink layer has been pressed against the bonding ink, such that the bonding ink is completely cured to form a bonding ink layer; and an ink-layer transferring process of peeling off the transfer sheet from the printing ink layer to transfer the printing ink layer onto the medium, and the ink-layer transferring process is performed after the bonding-ink layer forming process.

8. The printing method according to claim 7, further comprising:

a bonding-ink semi-curing process which is performed between the bonding-ink applying process and the bonding-ink layer forming process, wherein the bonding-ink semi-curing process irradiates the bonding ink being applied with the ultraviolet light while heating the bonding ink, in a state where the bonding ink is the solvent UV ink, but irradiates the bonding ink being applied with the ultraviolet light in a state where the bonding ink is the UV ink, such that the bonding ink is semi-cured.

9. The printing method according to claim 7, wherein in the bonding-ink layer forming process, in a state where the transfer sheet and the medium have been disposed in a case having an exhaust hole formed therein, or in a state where the medium has been disposed in the case having an opening and the exhaust hole and the opening has been covered with the transfer sheet such that the printing ink layer has been disposed in the case, while air in the case is sucked from the exhaust hole such that a pressure of an inside of the case decreases, irradiation with the ultraviolet light is performed.

10. The printing method according to claim 8, wherein in the bonding-ink layer forming process, in a state where the transfer sheet and the medium have been disposed in a case having an exhaust hole formed therein, or in a state where the medium has been disposed in the case having an opening and the exhaust hole and the opening has been covered with the transfer sheet such that the printing ink layer has been disposed in the case, while air in the case is sucked from the exhaust hole such that a pressure of an inside of the case decreases, irradiation with the ultraviolet light is performed.

11. The printing method according to claim 7, wherein in the bonding-ink layer forming process, while the transfer sheet is pressed from an opposite surface of the transfer sheet to a surface having the printing ink layer formed thereon, by a pressing member made of a rubber material capable of transmitting the ultraviolet light, irradiation with the ultraviolet light through the pressing member is performed.

12. The printing method according to claim 8, wherein in the bonding-ink layer forming process, while the transfer sheet is pressed from an opposite surface of the transfer sheet to a surface having the printing ink layer formed thereon, by a pressing member made of a rubber material capable of transmitting the ultraviolet light, irradiation with the ultraviolet light through the pressing member is performed.

* * * * *